US005456873A

United States Patent [19]

Nomizo

[11] Patent Number: 5,456,873

[45] Date of Patent: Oct. 10, 1995

[54] METHOD OF MANUFACTURING CUSHION MATERIAL

[75] Inventor: Fumio Nomizo, Toyota, Japan

[73] Assignee: Toyota Jidosha Kabushiki Kaisha, Toyota, Japan

[21] Appl. No.: 143,645

[22] Filed: Nov. 1, 1993

[30] Foreign Application Priority Data

Nov. 4, 1992 [JP] Japan ..... 4-294860

[51] Int. Cl.[6] ..... B29C 59/02

[52] U.S. Cl. ..... 264/122; 264/126; 264/327

[58] Field of Search ..... 264/121, 122, 264/126, 327, 517; 428/296

[56] References Cited

U.S. PATENT DOCUMENTS

| | | | |
|---|---|---|---|
| 4,186,165 | 1/1980 | Aberson et al. | 264/122 X |
| 4,568,581 | 2/1986 | Peoples, Jr. . | |
| 4,608,213 | 8/1986 | Kurumizawa et al. | 264/122 X |
| 4,649,014 | 3/1987 | Tochikawa . | |
| 4,663,225 | 5/1987 | Farley et al. . | |
| 4,737,404 | 4/1988 | Jackson | 428/296 X |
| 4,818,315 | 4/1989 | Hellgren et al. | 156/62.2 |
| 5,154,714 | 10/1992 | Nomura et al. | 604/366 |
| 5,169,580 | 12/1992 | Marcus . | |

FOREIGN PATENT DOCUMENTS

| | | |
|---|---|---|
| 212082 | 3/1987 | European Pat. Off. . |
| 214374 | 3/1987 | European Pat. Off. . |
| WO8809406 | 12/1988 | European Pat. Off. . |
| 401738 | 12/1990 | European Pat. Off. . |
| 55-148150 | 11/1980 | Japan . |
| 3170111 | 7/1991 | Japan . |
| 3170112 | 7/1991 | Japan . |
| 3292991 | 12/1991 | Japan . |

*Primary Examiner*—Mark A. Osele
*Attorney, Agent, or Firm*—Cushman, Darby & Cushman

[57] ABSTRACT

A method of manufacturing a cushion material including steps of: a mixed fiber manufacturing process in which main fibers and a plurality of types of heat-fusible fibers, which are formed of main fibers and sheath portions and whose sheath portions have different melting points, are mixed so as to make mixed fibers; a supplying process in which the mixed fibers are spread at a substantially uniform density at an entire one forming mold of a plurality of forming molds; and a heating process in which the mixed fibers spread at the entire one forming mold are heated such that a heating temperature of portions of a cushion material which are to be formed hard differs from a heating temperature of portions of the cushion material which are to be formed soft so that a number of types of the heat-fusible fibers which melt at the portions of the cushion material which are to be formed hard is greater than a number of types of the heat-fusible fibers which melt at the portions of the cushion material which are to be formed soft.

20 Claims, 8 Drawing Sheets

METHOD OF MANUFACTURING CUSHION MATERIAL

BACKGROUND OF THE INVENTION

1. Field of the Invention

The present invention relates to a method of manufacturing a cushion material having different hardnesses which is used for a vehicle seat, a bed, or the like.

2. Description of the Related Art

As illustrated as an example in FIG. 6, when a cushion material is used for a seat pad 70 of a seat cushion for a vehicle, the hardness of a central portion on 70A of the seat pad 70 is low, and the hardness of both side portions 70B is high so as to improve the seating comfort for the vehicle occupant and to improve the ability of the seat pad 70 to hold the vehicle occupant.

An example of a method of manufacturing such a cushion material having different hardnesses in different portions is disclosed in Japanese Patent Application Laid-Open No. 3-170112.

As illustrated in FIG. 7, in this conventional method of manufacturing a cushion material, when a plurality of heat-fusible fibers, which are shaped as cotton balls, are blown into a mold 72, cotton ball shaped heat-fusible fibers 74A (the black fibers in the drawing), which are hardened to an appropriate degree by a binder in advance, are mixed and blown in together with cotton ball shaped heat-fusible fibers 74B (the white fibers in the drawing), which are not bound by a binder, at a portion 72A within the mold 72 which corresponds to a central portion of the seat pad, i.e., at a portion which is to be formed soft. The heat-fusible fibers 74A and 74B are mixed such that the density of the heat-fusible fibers 74A is higher at portions 72B corresponding to both side portions of the seat pad, i.e., at portions which are to be formed hard. Thereafter, pressure is applied as illustrated in FIG. 8.

Subsequently, as illustrated in FIG. 9, the mold 72 which is filled with the heat-fusible fibers is placed within a heating portion 86 of a penetration-type heating apparatus 84 which is equipped with a hot air generating device 80 and a fan 82. The entire mold is heated at the same temperature.

However, in this method of manufacturing a cushion material, the process for manufacturing the cotton ball shaped heat-fusible fibers 74A and 74B is complicated. Further, in order to form the respective hard portions and soft portions of the cushion material by manipulating the mixing ratio of the heat-fusible fibers 74A and the heat-fusible fibers 74B, it is necessary to mix the heat-fusible fibers 74A and the heat-fusible fibers 74B uniformly in accordance with the respective soft portions and hard portions. This process is extremely difficult, and irregularities in hardness due to irregularities in the densities of the fibers occur easily.

SUMMARY OF THE INVENTION

In view of the aforementioned, an object of the present invention is to provide a method of manufacturing a cushion material which is simple and in which it is difficult for irregularities in hardness to be generated in respective portions which are to be formed hard and portions which are to be formed soft.

The method of manufacturing a cushion material of the present invention includes the steps of: a mixed fiber manufacturing process in which main fibers and a plurality of types of heat-fusible fibers, which are formed of main fibers and sheath portions and whose sheath portions have different melting points, are mixed so as to make mixed fibers; supplying process in which the mixed fibers are spread at a substantially uniform density at an entire one forming mold of a plurality of forming molds; and a heating process in which the mixed fibers spread at the entire one forming mold are heated such that a heating temperature of portions of a cushion material which are to be formed hard differs from a heating temperature of portions of the cushion material which are to be formed soft so that a number of types of the heat-fusible fibers which melt at the portions of the cushion material which are to be formed hard is greater than a number of types of the heat-fusible fibers which melt at the portions of the cushion material which are to be formed soft.

In accordance with the above-described method of manufacturing a cushion material of the present invention, in the mixed fibers manufacturing process, main fibers and a plurality of types of heat-fusible fibers, which are formed of main fibers and sheath portions and whose sheath portions have different melting points, are mixed so as to make mixed fibers. Subsequently, in a supplying process, the mixed fibers are spread at a substantially uniform density at an entire forming mold of a plurality of forming molds. Thereafter, in a heating process, at the mixed fibers spread at the entire forming mold, a heating temperature of portions of a cushion material which are to be formed hard differs from a heating temperature of portions of the cushion material which are to be formed soft so that a number of types of the heat-fusible fibers which melt at the portions of the cushion material which are to be formed hard is greater than a number of types of the heat-fusible fibers which melt at the portions of the cushion material which are to be formed soft. In other words, the mixed fibers, in which the main fibers are mixed with the plurality of types of heat-fusible fibers formed of main fibers and sheath portions and whose sheath portions have different melting points, is spread uniformly at the entire mold. The portions of the cushion material which are to be formed hard are heated at a high temperature as compared with the portions which are to be formed soft. The number of fusion points of the heat-fusible fibers of the hard portions of the cushion material is greater than the number of fusion points of the heat-fusible fibers of the soft portions so that a cushion material having hard portions and soft portions is manufactured.

Accordingly, in the present invention, there is no manufacturing process for manufacturing heat-fusible fibers which are shaped as cotton balls, as there is in the conventional art. The manufacturing process of the present invention is simple, and there is no need to vary the densities of the heat-fusible fibers. Therefore, it is difficult for irregularities in hardness to be generated in the portions which are to be formed soft and in the portions which are to be formed hard.

BRIEF DESCRIPTION OF THE DRAWINGS

FIG. 8 is a schematic view illustrating a mold clamping process of the method of manufacturing a cushion material relating to the conventional example.

DESCRIPTION OF THE PREFERRED EMBODIMENT

An embodiment of a method of manufacturing a cushion material relating to the present invention will be described in accordance with FIGS. 1 through 5.

Figure 4:
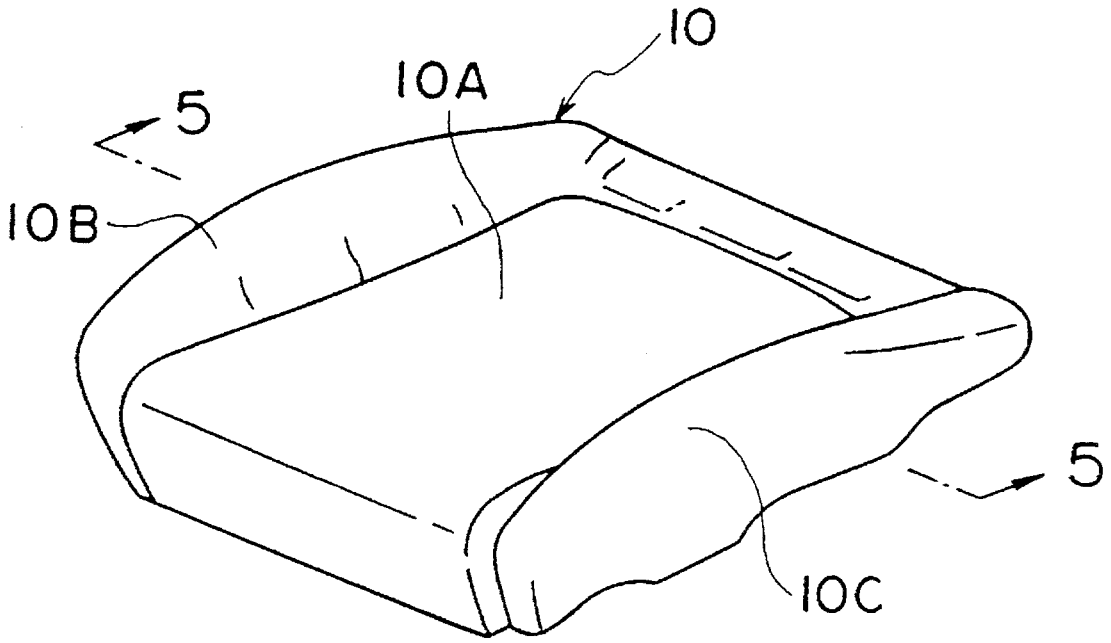
FIG. 4 is a perspective view illustrating the seat pad of a seat cushion for a vehicle manufactured by the method of manufacturing a cushion material relating to the embodiment of the present invention.

As illustrated in FIG. 4, a seat pad 10 of a seat cushion for a vehicle manufactured by the method of manufacturing a cushion material of the present embodiment is formed such that side portions 10B, 10C protrude upwardly with respect to a seat surface central portion 10A.

Figure 5:
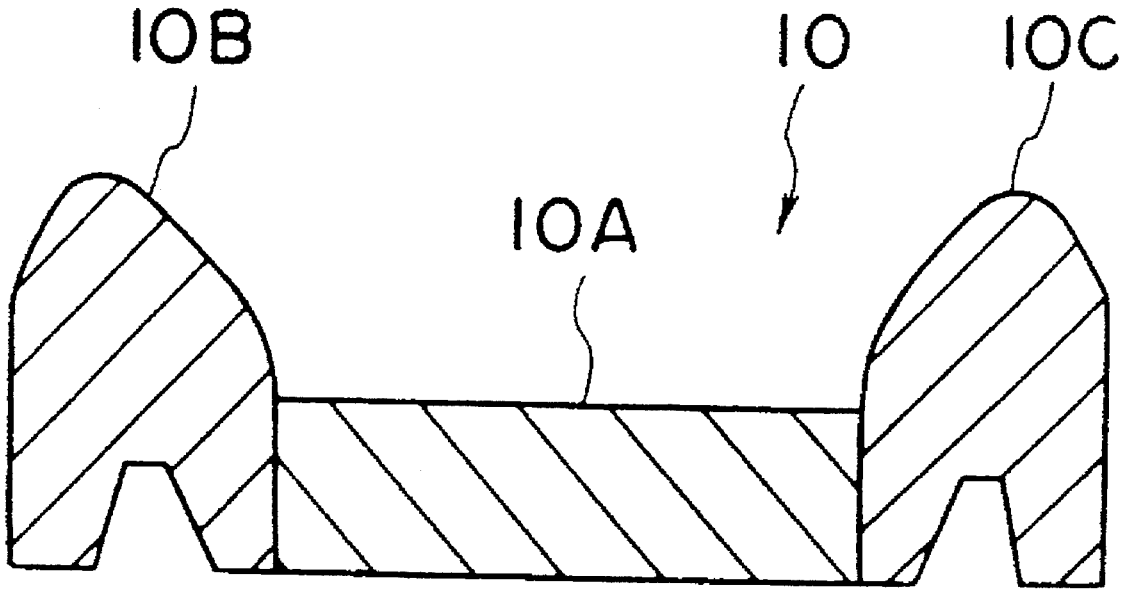
FIG. 5 is a sectional view taken along line 5—5 of FIG. 4.
Figure 6:
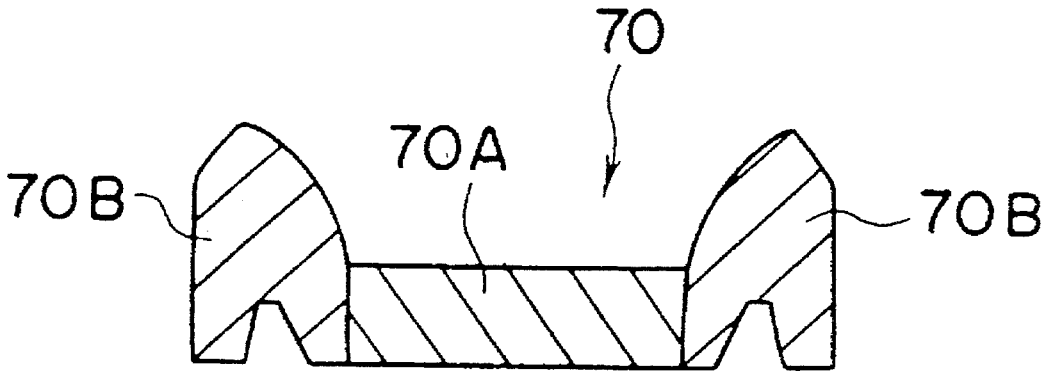
FIG. 6 PRIOR ART
FIG. 6 is a sectional view Illustrating a seat pad of a seat cushion for a vehicle manufactured by a method of manufacturing a cushion material relating to a conventional example.
Figure 7:
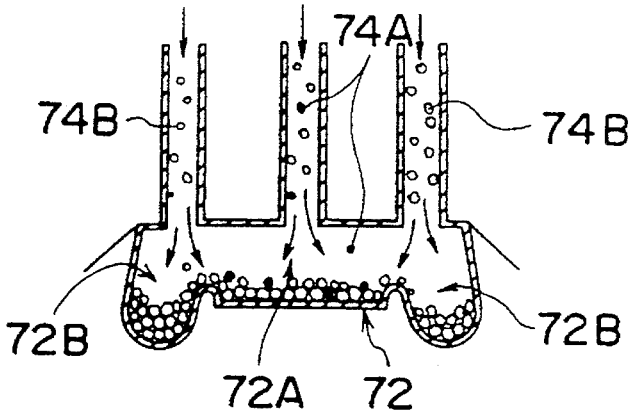
FIG. 7 PRIOR ART
FIG. 7 is a schematic view illustrating a supplying process of the method of manufacturing a cushion material relating to the conventional example.
Figure 8:
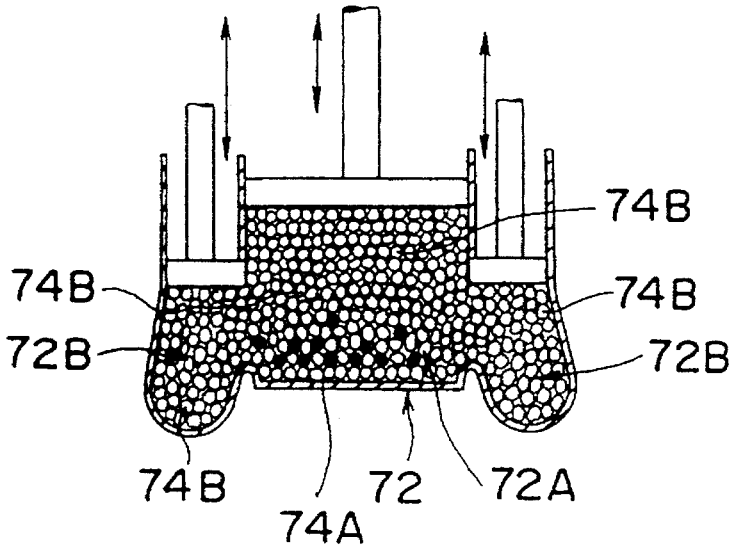
FIG. 8 PRIOR ART
FIG. 8 is a schematic view illustrating a mold clamping process of the method of manufacturing a cushion material relating to the embodiment of the present invention.
Figure 9:
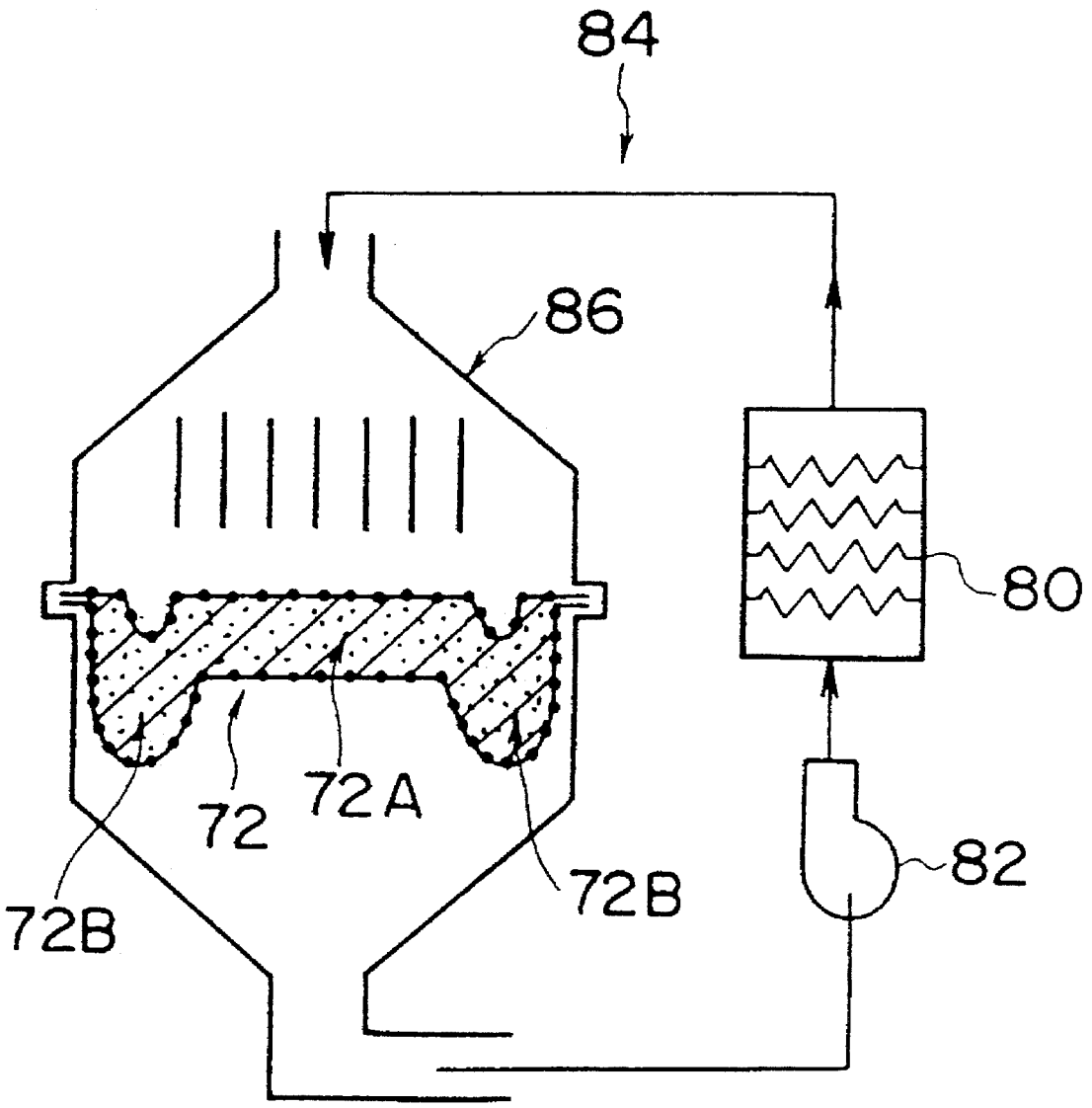
FIG. 9 PRIOR ART
FIG. 9 is a schematic view illustrating a penetration-type heating apparatus used in a heating process of the method of manufacturing a cushion material relating to the conventional example.

As shown in FIG. 5, the hardness of the seat surface central portion 10A of the seat pad 10 is low, and the hardness of the side portions 10B, 10C is high so that the seat is comfortable for a vehicle occupant. Further, because the side portions 10B, 10C reliably restrain the hips of the vehicle occupant, it is difficult for the occupant to slide towards the sides of the seat.

Next, the method of manufacturing the seat pad 10 will be described in detail.

Figure 2A:
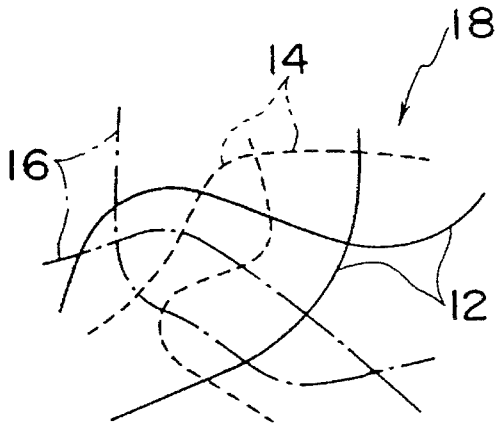
FIG. 2A is a schematic view illustrating mixed fibers of the method of manufacturing a cushion material relating to the embodiment of the present invention.

As an example, the following three types of fibers illustrated in Table 1 are used: main fibers (melting point: 250° C.) and two types of heat-fusible fibers A, B, which respectively have the same core portion as the main fiber, but have a sheath portion of a different melting point at the outer periphery of the core portion. The melting point of the sheath portion of the heat-fusible fibers A is 150° C. and that of the heat-Fusible fibers B is 180° C. The fibers are mixed uniformly so that the mixing ratio of the main fibers, the heat-fusible fibers A and the heat-fusible fibers B is 65%, 20%, 15%. As illustrated in FIG. 2A, mixed fibers 18 formed of main fibers 12, heat-fusible fibers A 14, and heat-fusible fibers B 16 are thereby manufactured. (Hereinafter, this process will be referred to as the "mixed fiber manufacturing process").

TABLE 1

| Type of Fiber | Fiber Form | Melting Point | Mixing Ratio |
|---|---|---|---|
| main fiber | 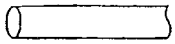 ordinary one-layer structure | 250° C. | 65% |
| heat-fusible fiber A | 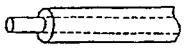 2-layer core/sheath structure | core portion: 250° C. sheath portion: 150° C. | 20% |
| heat-fusible fiber B | 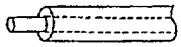 2-layer core/sheath structure | core portion: 250° C. sheath portion: 180° C. | 15% |

Figure 2B:
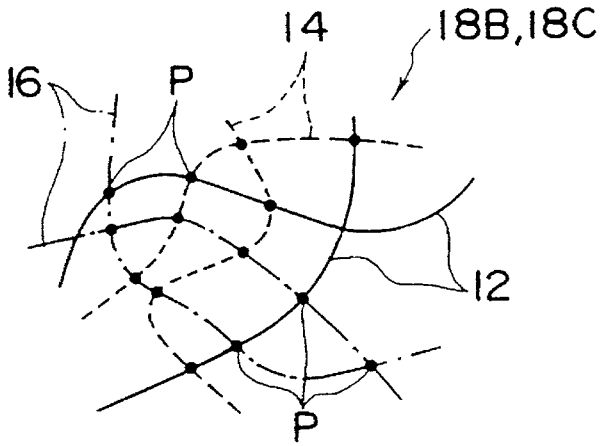
FIG. 2B is a schematic view illustrating a state of heat-fusible fibers of a hard portion of a seat pad manufactured by the method of manufacturing a cushion material relating to the embodiment of the present invention.
Figure 2C:
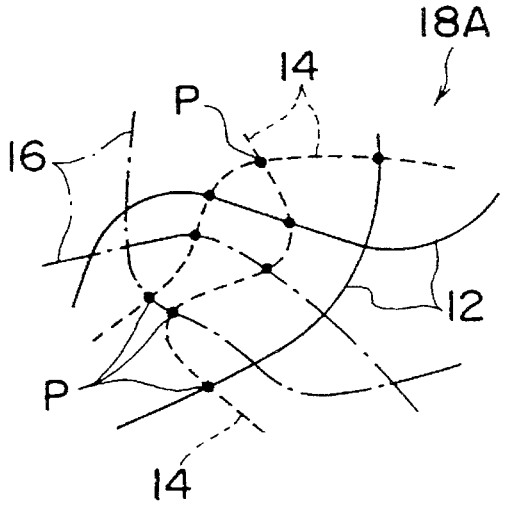
FIG. 2C is a schematic view of a state of heat-fusible fibers of a soft portion of the seat pad manufactured by the method of manufacturing a cushion material relating to the embodiment of the present invention.
Figure 3:
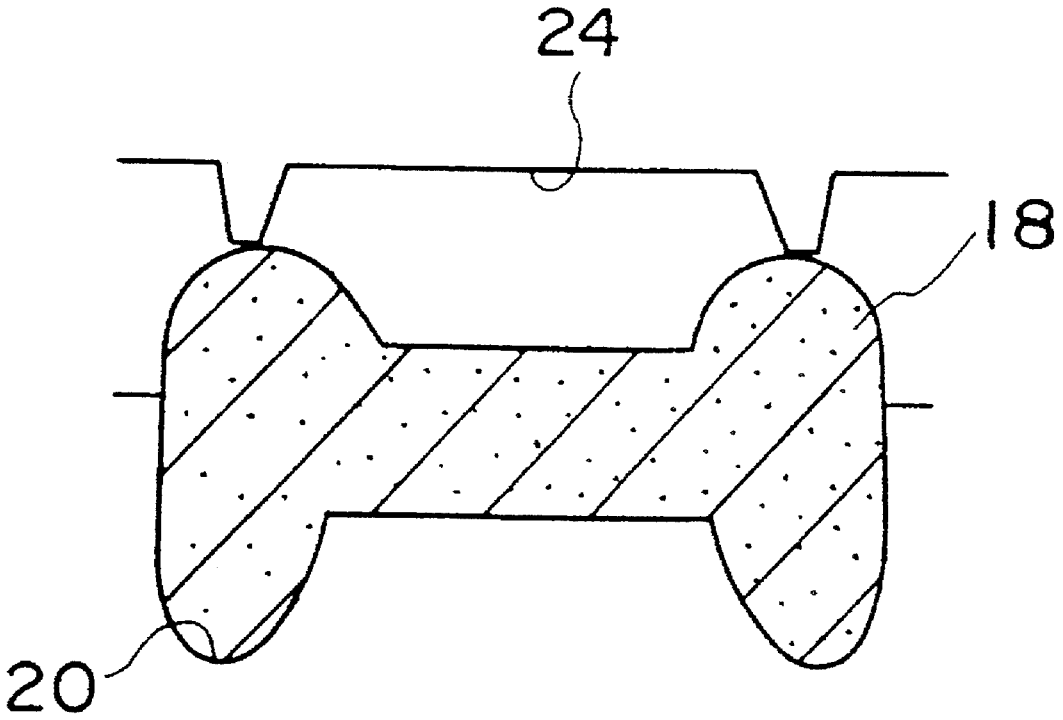

Next, as illustrated in FIG. 3, the mixed fibers 18 manufactured in the mixed fiber manufacturing process are spread evenly on a lower mold 20 which forms the upper surface of the seat pad 10. (Hereinafter, this process will be referred to as the "supplying process"). The lower mold 20 is formed of punching metal having a predetermined rate of hole area (i.e., the area of the holes per unit area). An upper mold 24, which is similarly formed of punching metal and which is used to form the bottom surface of the seat pad 10, is clamped with the lower mold 20 (hereinafter, the "mold clamping process"). The mixed fibers 18 are to be measured and spread by taking the volume of the interior of the molds into consideration so that the overall density of the entire seat pad 10 is a predetermined value when the molds are clamped. Therefore, as can be seen in FIGS. 1 through 3, the mixed fibers 18 are compressed by the clamping of the molds such that a predetermined internal compressive force is generated.

Figure 1:
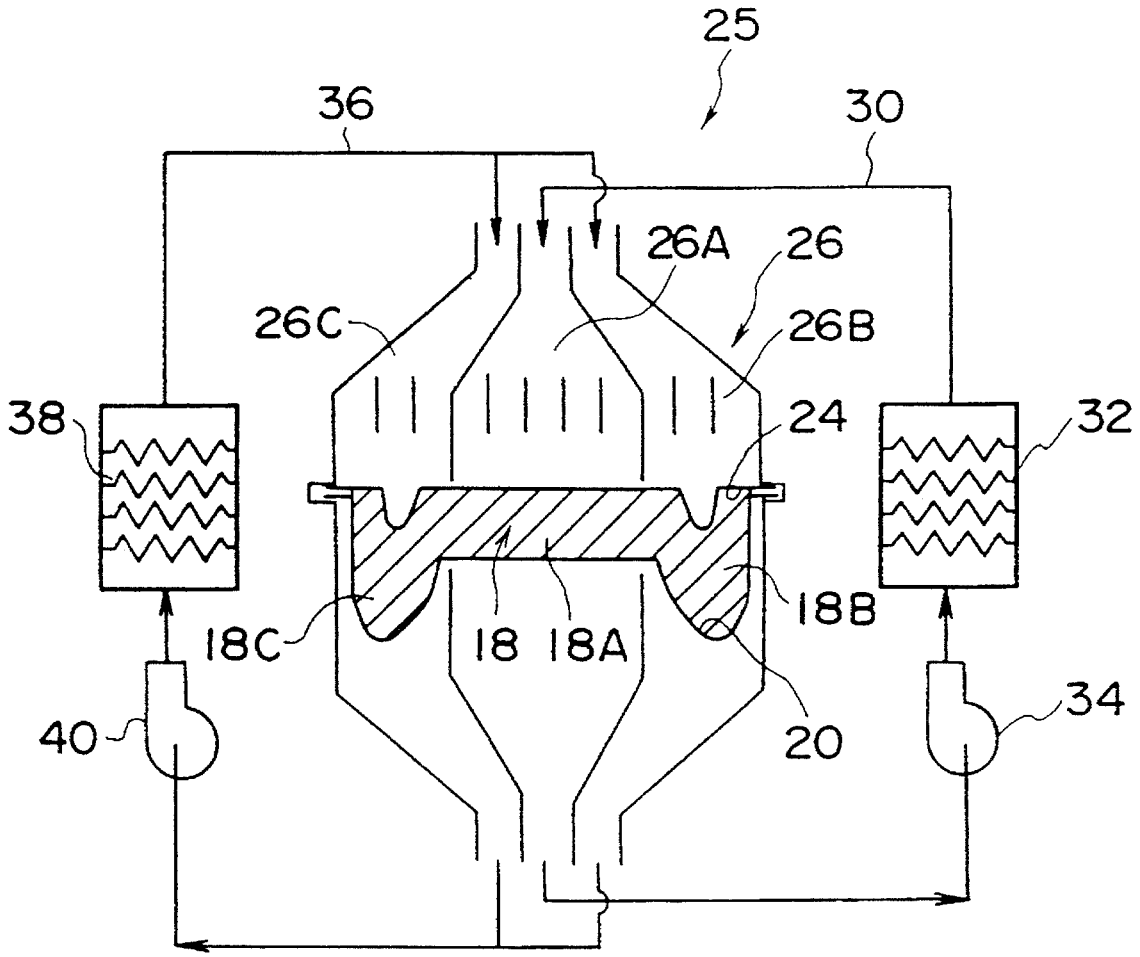
FIG. 1 is a schematic view illustrating a penetration-type heating apparatus used in a heating process of a method of manufacturing a cushion material relating to an embodiment of the present invention.

Next, as illustrated in FIG. 1, the clamped mixed fibers 18 are set within a heating portion 26 of a penetration-type heating apparatus 25.

The interior of the heating portion 26 of the penetration-type heating apparatus 25 is divided into a low temperature heating portion 26A and high temperature heating portions 26B, 26C. The low temperature heating portion 26A heats a seat surface central portion corresponding portion 18A of the clamped mixed fibers 18 which corresponds to the seat surface central portion 10A of the seat pad 10. The high temperature heating portions 26B, 26C heat side portion corresponding portions 18B, 18C of the clamped mixed fibers 18 which correspond to the side portions 10B, 10C of the seat pad 10.

The low temperature heating portion 26A is connected, via a duct 30, to a hot air generating device 32 and to a fan 34 which blows heat generated by the hot air generating device 32. The seat surface central portion corresponding to portion 18A of the clamped mixed fibers 18 is thereby heated to, for example, 170° C.

Further, the high temperature heating portions 26B, 26C of the penetration-type heating apparatus 25 are connected, via respective ducts 36, to a hot air generating device 38 and to a fan 40 which blows heat generated by the hot air generating device 38. The side portions corresponding to portions 18B, 18C of the clamped mixed fibers 18 are thereby heated to, for example, 200° C.

By heating the clamped mixed fibers 18 in this way, both the sheath portions of the heat-fusible fibers A 14 and the sheath portions of the heat-fusible fibers B 16 are melted by heat as illustrated in FIG. 2B at the side portions corresponding to portions 18B, 18C of the clamped mixed fibers 18. Therefore, the main fibers 12, the heat-fusible fibers A 14 and the heat-fusible fibers B 16 are fused together at fusion points P. On the other hand, as illustrated in FIG. 2C, at the seat surface central portion corresponding to portion 18A of the clamped mixed fibers 18, only the sheath portions of the heat-fusible fibers A 14 are melted by heat. Therefore, the heat-fusible fibers A 14 fuse with the main fibers 12 and the heat-fusible fibers B 16 at the fusion points P.

Compared to the number of fusion points P at the seat surface central portion corresponding to portion 18A of the mixed fibers 18, there are a large number of fusion points P at the side portion corresponding to portions 18B, 18C of the mixed fibers 18. The hardness of the side portion corresponding to portions 18B, 18C of the mixed fibers 18 which correspond to the side portions 10B, 10C of the seat pad 10 is high as compared with the hardness of the seat surface central portion corresponding to portion 18A of the mixed fibers 18 which corresponds to the seat surface central portion 10A of the seat pad 10.

In other words, heating (i.e., heating processing) is carried out at different temperatures for the side portions corresponding to portions 18B, 18C of the clamped mixed fibers 18 which are to be formed hard and for the seat surface central portion corresponding to portion 18A which is to be formed soft. In this way, at the side portion corresponding to portions 18B, 18C of the clamped mixed fibers 18 which are to be formed hard, the number of types of heat-fusible fibers whose sheath portions melt (i.e., two types: the heat-fusible fibers A 14 and the heat-fusible fibers B 16) is greater than the number of types of heat-fusible fibers (i.e., one type: the heat-fusible fibers A 14) which melt at the seat surface central portion corresponding to portion 18A which is to be formed soft.

Thereafter, a cooling process and a process for removing the seat pad 10 from the molds, which are both commonly-known processes, are carried out so that the seat pad 10 is completed.

As described above, in the present invention, there is no manufacturing process for manufacturing the cotton ball shaped heat-fusible fibers as there is in the conventional art. Further, the manufacturing process of the present invention for manufacturing the mixed fibers is simple, and there is no need to vary the densities of the heat-fusible fibers. Therefore, it is difficult for irregularities in hardness to be generated in the portions which are to be formed soft and in the portions which are to be formed hard.

In the present embodiment, the seat surface central portion corresponding to portion 18A of the clamped mixed fibers 18 which is to be formed soft is heated to 170° C., and simultaneously, the side portions corresponding to portions 18B, 18C which are to be formed hard are heated to 200° C. However, an alternative method may be used in which the entire mixed fibers 18 clamped in the molds are heated to 170° C., and thereafter, only the side portions corresponding to portions 18B, 18C of the clamped mixed fibers 18 which are to be formed hard are heated to 200° C.

Further, in order to vary the hardness of the seat pad 10, the mixing ratio of the heat-fusible fibers A 14 and the heat-fusible fibers B 16 may be varied. For example, if the main fibers 12 are decreased and the heat-fusible fibers A 14 are increased, the entire seat pad 10 becomes harder. On the other hand, if the main fibers 12 are decreased and the heat-fusible fibers B 16 are increased, only the side portions 10B, 10C of the seat pad 10 become harder. Further, if the heat-fusible fibers A 14 are decreased and the heat-fusible fibers B 16 are increased, the seat surface central portion 10A of the seat pad becomes softer and the side portions 10B, 10C of the seat pad 10 become harder.

Moreover, in the present embodiment, the mixed fibers 18 are formed of the main fibers 12 and two types of heat-fusible fibers having different sheath portion melting points. However, the mixed fibers 18 may be formed of a main fiber and three or more types of heat-fusible fibers having different melting points of the sheath portions.

In the present embodiment, a method of manufacturing a seat pad of a seat cushion for a vehicle is described. However, the method of manufacturing a cushion material of the present invention is not limited to the manufacturing of seat pads of scat cushions for vehicles. The method of the present invention is directed toward the manufacturing of cushion materials in general, and may also be applied to chairs, beds and the like.

What is claimed is:

1. A method of manufacturing a cushion material comprising the steps of:

a mixed fiber manufacturing process in which main fibers and a plurality of types of heat-fusible fibers, which are formed of main fibers and sheath portions and whose sheath portions have different melting points, are mixed so as to make mixed fibers;

a supplying process in which said mixed fibers are spread at a substantially uniform density at an entire one forming mold of a plurality of forming molds; and a heating process in which said mixed fibers spread at said entire one forming mold are heated such that a heating temperature of portions of a cushion material which are to be formed hard differs from a heating temperature of portions of said cushion material which are to be formed soft so that a number of types of said heat-fusible fibers which melt at the portions of said cushion material which are to be formed hard is greater than a number of types of said heat-fusible fibers which melt at the portions of said cushion material which are to be formed soft.

2. A method of manufacturing a cushion material according to claim 1, wherein said heating process includes a first mixed fiber heating process in which said mixed fibers are heated at a first temperature which is lower than a melting point of said main fibers and which is higher than a melting point of said sheath portions of at least one type of said heat-fusible fibers of said plurality of types of said heat-fusible fibers, and a second mixed fiber heating process in which said mixed fibers are heated at a second temperature which is lower than the melting point of said main fibers and which is higher than said first temperature.

3. A method of manufacturing a cushion material according to claim 2, wherein in said heating process, said first mixed fiber heating process and said mixed fiber heating process are effected simultaneously.

4. A method of manufacturing a cushion material according to claim 2, wherein said heating process, said second mixed fiber heating process is effected after said first mixed fiber heating process.

5. A method of manufacturing a cushion material according to claim 4, wherein in said first mixed fiber heating process, said mixed fibers at the portions of said cushion material which are to be formed hard and said mixed fibers at the portions of said cushion material which are to be formed soft are heated simultaneously.

6. A method of manufacturing a cushion material according to claim 1, wherein in said mixed fiber manufacturing process, mixing is effected such that respective proportions of said main fibers included in said mixed fibers and of said plurality of types of said heat-fusible fibers included in said mixed fibers are constant throughout said entire mixed fibers.

7. A method of manufacturing a cushion material according to claim 1, wherein in said supplying process, said mixed fibers are supplied so that a density of said mixed fibers are substantially uniform when said mixed fibers are compressed by said plurality of forming molds.

8. A method of manufacturing a cushion material according to claim 1, further comprising the step of:

a mold clamping process in which said mixed fibers which were spread in said supplying process are compressed and formed by said plurality of forming molds.

9. A method of manufacturing a cushion material according to claim 8, wherein in said heating process, said mixed fibers and said plurality of forming molds are heated in a state in which said mixed fibers are compressed in said mold clamping process.

10. A method of manufacturing a cushion material according to claim 1, wherein said sheath portions of said plurality of types of said heat-fusible fibers are provided at respective outer peripheries of said main fibers which correspond to said heat-fusible fibers.

11. A method of manufacturing a cushion material comprising:

a mixed fiber manufacturing process in which main fibers and a plurality of types of heat-fusible fibers, which are formed of main fibers and sheath portions provided at respective outer peripheries of said main fibers and whose sheath portions have different melting points, are mixed so as to make mixed fibers;

a supplying process in which said mixed fibers are spread at a substantially uniform density at an entire one forming mold of a plurality of forming molds;

a mold clamping process in which said mixed fibers which were spread in said supplying process are compressed and formed by said plurality of forming molds; and a heating process in which said mixed fibers spread at said entire one forming mold are heated such that a heating temperature of portions of a cushion material which are to be formed hard is higher than a heating temperature of portions of said cushion material which are to be formed soft so that a number of types of said heat-fusible fibers which melt at the portions of said cushion material which are to be formed hard is greater than a number of types of said heat-fusible fibers which melt at the portions of said cushion material which are to be formed soft.

12. A method of manufacturing a cushion material according to claim 11, wherein said heating process includes a first mixed fiber heating process in which said mixed fibers are heated at a first temperature which is lower than a melting point of said main fibers and which is higher than a melting point of said sheath portions of at least one type of said heat-fusible fibers of said plurality of types of said heat-fusible fibers, and a second mixed fiber heating process in which said mixed fibers are heated at a second temperature which is lower than the melting point of said main fibers and which is higher than said first temperature.

13. A method of manufacturing a cushion material according to claim 12, wherein in said heating process, said first mixed fiber heating process and said second mixed fiber heating process are effected simultaneously.

14. A method of manufacturing a cushion material according to claim 12, wherein in said heating process, said second mixed fiber heating process is effected after said first mixed fiber heating process.

15. A method of manufacturing a cushion material according to claim 14, wherein in said first mixed fiber heating process, said mixed fibers at the portions of said cushion material which are to be formed hard and said mixed fibers at the portions of said cushion material which are to be formed soft are heated at the same time.

16. A method of manufacturing a cushion material according to claim 11, wherein in said mixed fiber manufacturing process, mixing is effected such that respective proportions of said main fibers included in said mixed fibers and of said plurality of types of said heat-fusible fibers included in said mixed fibers are constant throughout said entire mixed fibers.

17. A method of manufacturing a cushion material according to claim 11, wherein in said supplying process, said mixed fibers are supplied so that a density of said mixed fibers are substantially uniform when said mixed fibers are compressed by said plurality of forming molds.

18. A method of manufacturing a cushion material according to claim 11, wherein said sheath portions of said plurality of types of said heat-fusible fibers are provided coaxially with said main fibers corresponding to said heat-fusible fibers, and are provided at entire respective outer peripheries of said main fibers corresponding to said heat-fusible fibers.

19. A method of manufacturing a cushion material according to claim 11, wherein in said heating process, said mixed fibers and said plurality of forming molds are heated in a state in which said mixed fibers are compressed in said mold clamping process.

20. A method of manufacturing a cushion material according to claim 11, wherein said heating process is effected by blowing hot air.

* * * * *